United States Patent [19]

Guinn et al.

[11] 4,067,282

[45] Jan. 10, 1978

[54] RELEASABLE AND RETRIEVABLE MOORING SYSTEM

[76] Inventors: David C. Guinn; Archie K. Haggard; John P. Thomas, all of P.O. Box 1126, Houston, Tex. 77001

[21] Appl. No.: 729,492

[22] Filed: Oct. 4, 1976

[51] Int. Cl.[2] ..... B63B 21/50

[52] U.S. Cl. ..... 114/230; 114/293

[58] Field of Search ..... 114/230, 293, 294, 297, 114/144 B, 264, 265, 51, 253, 254, 200, 210, 199; 9/8 P, 8 R, 9; 254/174, 175.5

[56] References Cited

U.S. PATENT DOCUMENTS

| | | | |
|---|---|---|---|
| 3,425,070 | 2/1969 | Clark | 9/9 |
| 3,654,649 | 4/1972 | Richardson | 114/294 X |
| 3,848,226 | 11/1974 | Perez | 9/8 R X |
| 3,936,895 | 2/1976 | Talkington | 9/8 R |

*Primary Examiner*—Stephen G. Kunin
*Assistant Examiner*—Sherman D. Basinger
*Attorney, Agent, or Firm*—Fulbright & Jaworski

[57] ABSTRACT

A releasable and retrievable mooring system for vessels is disclosed which includes anchors and anchor chains each having an explosive link arranged to separate the anchor upon detonation, a transponder operable from the vessel to send acoustic signals and receivers secured to the links to detonate them, a marker buoy having a line to either or both the anchor or anchor chain downstream but adjacent to the link, and a stopper upstream but adjacent to the link to prevent the link end of the anchor chain from falling into its locker when reeled in. The marker buoys either float on the water's surface or are submerged and releasable to the surface. Each includes retrieving lines extending to the anchor chain adjacent but downstream of the link or to the link. When using floating buoys, the retrieving lines are attached to strippers slidable on the anchor chains which includes stripper stoppers to limit travel of the strippers. Detonation of the link frees the vessel from the anchors for movement off of location and in repositioning the vessel on location, a workboat moves the previously retrieved portion of the anchor chain to the location of its anchor marker buoy, retrieves the submerged portion of the anchor chain by hoisting the line connected to it, and then reconnects the sections of the chain by reconnecting the explosive link. Other details, features and advantages are disclosed.

8 Claims, 17 Drawing Figures

34
32
16
10
16
18
28
11
11
28
18
26
30
36
36
22
26
11
14
14
22
11
24
12
12
20
24

10
16
30
18
11
11
18
26
26
36
36
28
14
14
24
12
12
24
11
22
28
22
14
20

18
18
36
36
10
38
16
14
14
28
14
18
22
20
18
26
26
11
12
24
20
11
22
28
24
12
14

18
36
14
10
38
14
18
16
16
40
22
14
11
36
11
26
18
26
24
12
24
20
11
22
28
14
12

18
10
36
14
16
38
11
28
18
26
26
18
36
11
22
12
24
20
11
22
28
24
11
12
14

10
11
16a
11
16a
36
36
28a
28a
14
14
24
11
12
12
11

RELEASABLE AND RETRIEVABLE MOORING SYSTEM

BACKGROUND OF THE INVENTION

As drilling operations are conducted in deeper and deeper water, such as 300 feet and more, it becomes impractical and uneconomical to drill from platforms supported by the underwater ground. These drilling operations are better conducted by floating ship-shaped vessels and semi-submersibles. Mooring systems or station-keeping systems for such vessels are used to maintain the vessel on location. It sometimes becomes necessary or desirable to move off location quickly, such as in bad weather, and this has always presented problems for moored vessels since the usual procedure has been to release and drop all anchor chains, or cut a chain link while under tension by torch. To reposition the vessel on location, it then becomes necessary to grapple for the released anchors and anchor chains. High day rates for labor and capital investment dictate the adoption of a design for moving off location quickly and then repositioning the vessel on location quickly and simply thus reducing the time required for such purposes so that drilling can be commenced again as soon as possible.

It would be highly advantageous to provide a mooring system in which the anchor chains can be released from the anchors with only a predetermined minimum of anchor chain left at the bottom, and when re-positioning it would not be necessary to grapple for the submerged portion of anchor chains left on bottom thereby permitting the vessel to be re-positioned on location quickly and by a relatively simple procedure.

SUMMARY

Accordingly, the present invention is directed to a releasable and retrievable mooring system for floating vessels used in drilling offshore in which the mooring system may be released and retrieved readily and easily with a minimum of time, labor and expense.

It is therefore an object of the present invention to provide a releasable and retrievable mooring system for floating vessels in which the anchor and only a minimum amount of anchor chain can readily and easily be released so that the vessel can be quickly moved off location when necessary or desirable.

A further object of the present invention is the provision of such a releasable and retrievable mooring system in which the released anchor and anchor chain can be retrieved and reattached to the anchor chain readily and easily and without the use of grapples or divers.

A further object of the present invention is the provision of such a releasable and retrievable mooring system for floating vessels in which the anchor chain has an explosive link arranged to separate the anchor chain upon detonation in response to an acoustic signal sent from the vessel, and which includes a surface marker buoy having a line extending from it to a stripper slidably disposed about the anchor chain so that hoisting of the line brings the submerged end of the anchor chain adjacent the explosive link to the surface.

A further object would be that a subsurface buoy could be used with a tag line attached to it and when the buoy is released to the surface via an acoustic signal it would be possible to install a chaser around the tag line attached to a separate retrieval line. The chaser and retrieval line would then run down the tag line to mate with its complement attached to the anchor link thereby facilitating retrieval.

A further object of the present invention is the provision of explosive links which detonate at different acoustic signals and includes means to send these different acoustic signals from the vessel.

A further object is the provision of such a releasable and retrievable mooring system in which a workboat attaches a portable stripper to the retrieved anchor adjacent the detonated explosive link, and moves it to the location of the anchor buoy, retrieves the line extending from the anchor buoy so that it pulls up the anchor chain and explosive link and then the two free sections of the chain are reconnected by inserting another explosive link or replacement components.

A further object of the present invention is the provision of such a releasable and retrievable mooring system which is economical, avoids the use of divers, grapples, and the like, and by which the vessel can be free to move off location rapidly and safely and the vessel can be repositioned over location by reconnecting the anchor lines quickly and readily so that drilling can again be commenced in a relatively short time.

Other and further objects, features and advantages of the system appear throughout the specification and claims.

DESCRIPTION OF PREFERRED EMBODIMENTS

Figure 1:
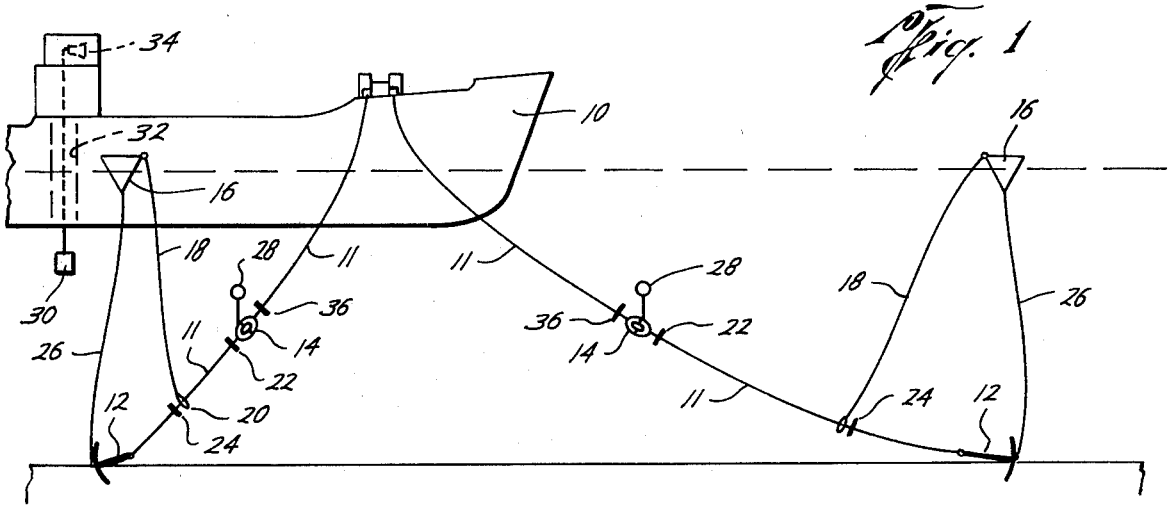
FIG. 1 is a schematic, fragmentary side view illustrating a releasable and retrievable mooring system according to the invention and illustrating a vessel moored on location.

Referring now to the drawings, and particularly to FIG. 1, the releasable and retrievable mooring system is illustrated mooring the vessel 10 on location for drilling or such other purposes as may be desired. While the releasable and retrievable mooring system of the present invention is particularly adapted and suited for use in drilling oil wells from floating vessels or semi-submersibles, it may be used for mooring or anchoring other floating vessels such as derrick barges, pipelaying barges or other objects as desired.

The mooring system includes a plurality of anchor chains 11 provided with the anchors 12 at their downstream ends. Explosive links 14 are provided in the anchor chains 11 which are arranged to be separated by detonation as later described. The explosive links 14 may be located any place in the anchor chains 11 as desired, but preferably they are located near the downstream end of the anchor chains 11 so that a minimum of anchor chain is left on bottom when the links 14 are separated.

Marker buoys 16 are provided which include the lines, here shown as stripper pendants 18 which are secured to the anchor chains 11 downstream of the explosive links 14. While the lines 18 can be secured directly to the anchor chains 11, in this embodiment of the invention the lines 18 are secured to the strippers 20 which are slidable on the anchor chains 11 and a pair of stripper stoppers 22 and 24 are disposed on opposite sides of the strippers 20. The stoppers 22 preferably are located adjacent the explosive link 14 and the stripper stoppers 24 are located a short distance upstream from the anchor 12. Thus, the strippers 20 have limited sliding movement on the anchor chain 10.

Preferably, in shallower waters, the lines 26 also extend from the marker buoys 16 and are connected to the anchors 12.

Each explosive link 14 has an acoustic receiver or sonar buoy 28 which is adapted to receive an acoustic signal from the transponder 30 which is lowered through the moon pool 32 in the vessel 10 or over the side or through its own tube and operated by the control 34 in the control room of the vessel 10. Preferably, each of the acoustic receivers 28 is arranged to detonate its explosive link 14 at a different acoustic signal, which the transponder 30 is arranged to emit. Thus, each of the explosive links can be selectively detonated and thus separated by emitting the signal for that particular explosive link from the transponder 30 as determined by the operator in the control room. Since any desired transponder, controls, acoustic or sonar buoys can be used which are readily available on the commercial market, no detailed description thereof is given or deemed necessary.

Preferably, chain stoppers 36 are provided on the anchor cables 11 adjacent but upstream of the explosive link 14 which prevent ends of the anchor chains 11 from falling into their chain lockers, not shown, on the vessel 10.

While the strippers and stripper stoppers may be formed as desired to withstand the conditions of use, strippers comprised of a ring of 5-inch bar stack and stripper stoppers which are removable bars installed across the anchor chain 11 are satisfactory as hereinafter described.

Figure 8:
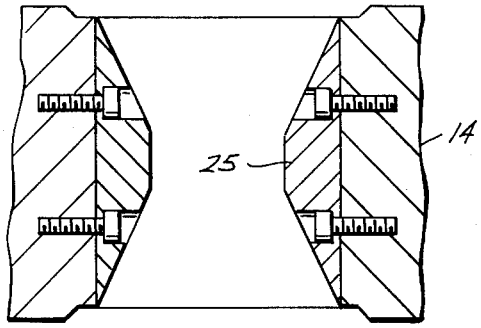
FIG. 8*a* is a view similar to that of FIG. 7 but illustrates the explosive link after detonation.
Figure 9:
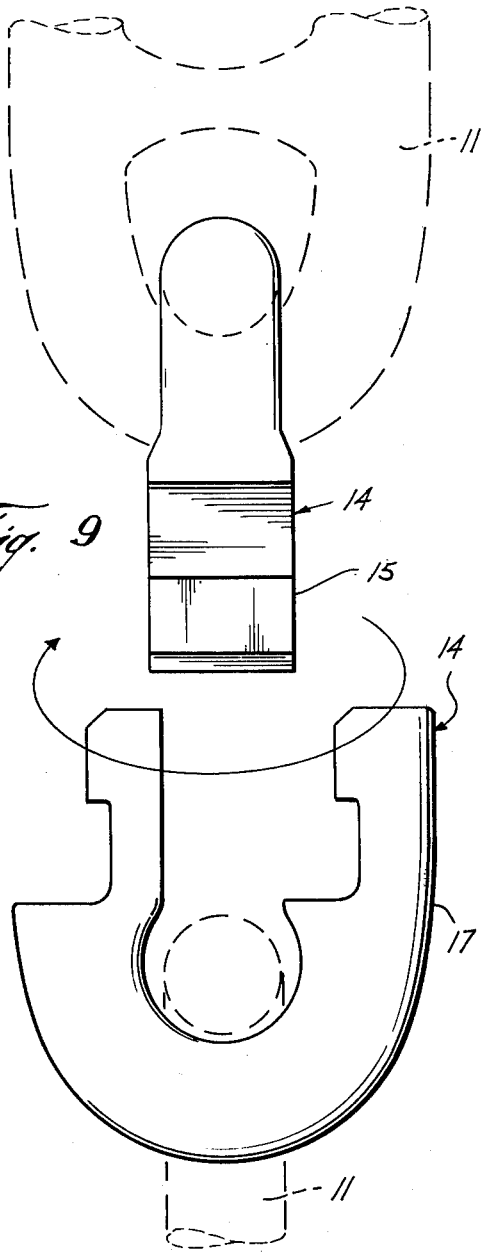
FIG. 9 is an elevational view illustrating the explosive link separating after detonation.
Figure 7:
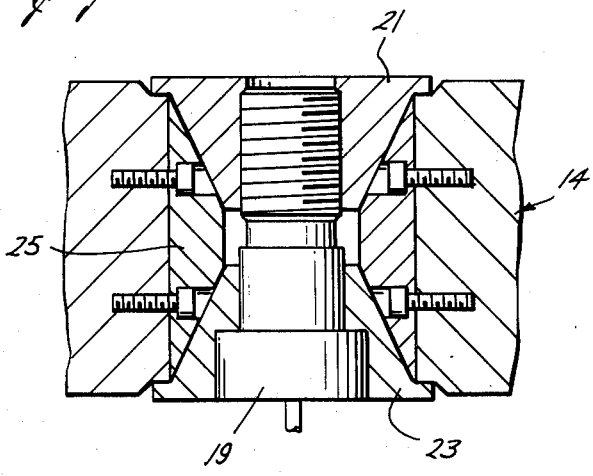
FIG. 7 is a view taken along the line 7—7 of FIG. 6.

Details of a suitable explosive link 14 are best illustrated in FIGS. 6–9, to which reference is now made, and which include a pair of separable interfitting link members 15 and 17 secured together by means of a separation explosive bolt 19 threaded into a truncated cone 21 and extending through and secured in a truncated cone 23, which cones are disposed within the mating cone member 25 threaded or otherwise secured into the body of the separable link elements 15 and 17. The explosive link 14 does not disintegrate upon detonation, but the explosive bolt 19 does and thus separates the cones 21 and 23 which permits separation of the separable links 15 and 17 as best illustrated in FIGS. 8 and 9.

No more description is given or deemed necessary of the explosive link as it is a commercial release link with separation bolt marketed by Hi-Shear Corporation of Torrance, California.

Figure 10:
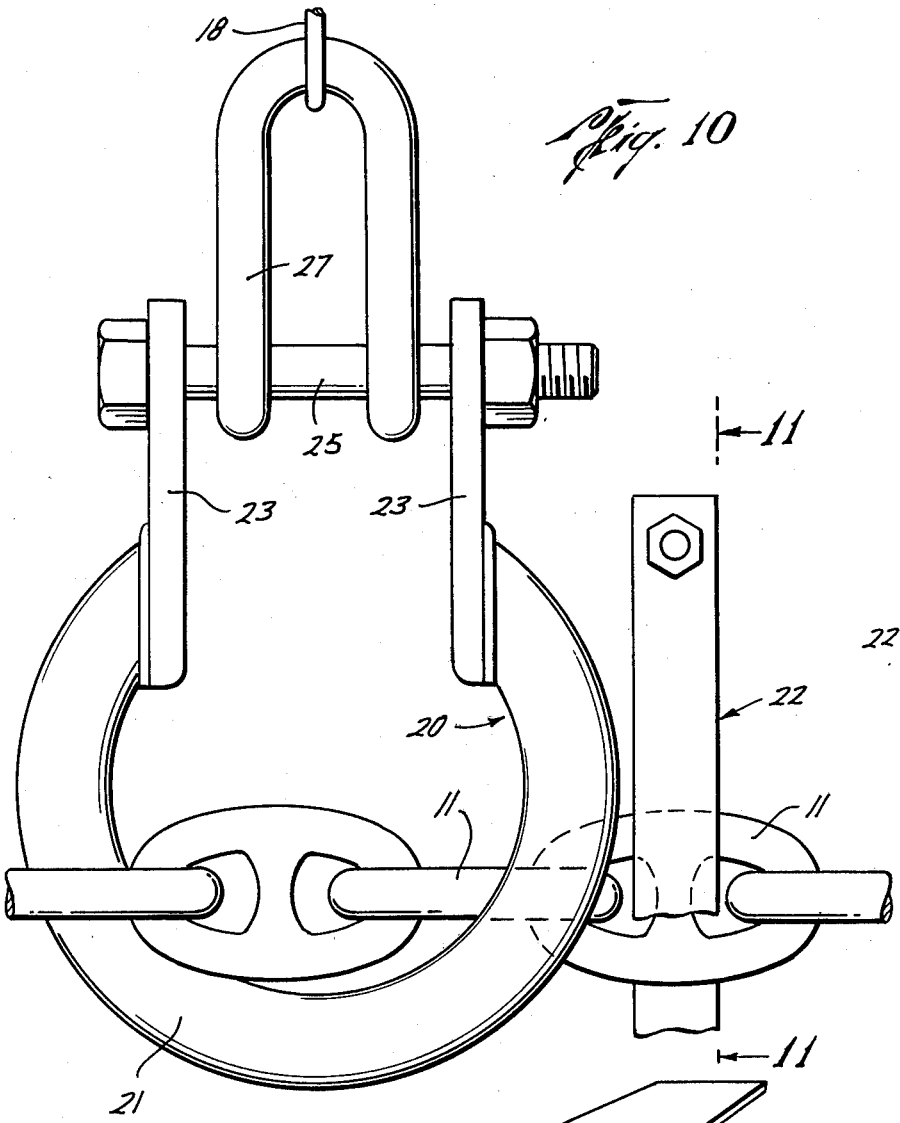
FIG. 10 is an elevational view of a stripper slidably disposed about the anchor chain and a stopper to restrain further movement of the stripper stopper.
Figure 11:
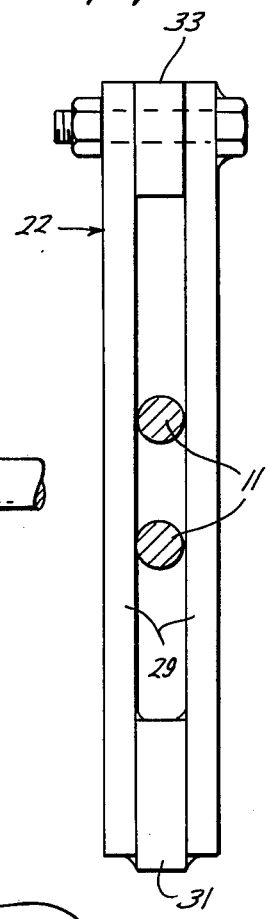
FIG. 11 is a view taken along the line 11—11 of FIG. 10.
Figure 12:
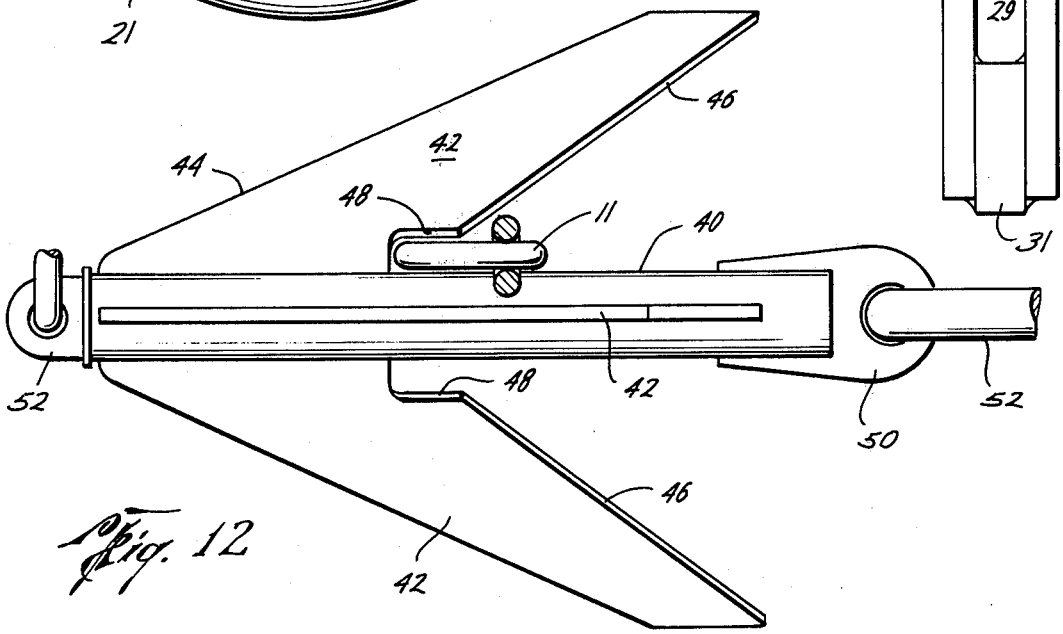
FIG. 12 illustrates a grapple according to the invention which can be used in case of a failure in the system.

Details of satisfactory strippers 20 and stoppers for use as the stripper stoppers 22, 24 and 36 are illustrated in FIGS. 10 and 11 to which reference is now made. The stripper 20 includes a ring-like member 21 of a size sufficient to fit about the anchor chain 11 and which is provided with a generally U-shaped yoke formed of the uprights 23 and the cross-bolt 25 to which is secured another generally U-shaped shackle 27 to which is secured the pendant line 18 which extends up to the marker buoy, not shown in these views. Such a stripper is satisfactory, however, any desired means to slidably secure the pendant 18 to the anchor chain 11 which will withstand the conditions of use can be used.

All stripper stoppers are the same, and for convenience, only the stripper stopper 22 is described.

The stripper stopper 22 includes a pair of spaced bars 29 welded to a spacer 31 at one end and bolted to a spacer 23 at the other end so that it can be secured about the anchor chain link 11. The bars 29 are of a length to prevent a stripper 20 from sliding about them. Since any desired form of stopper can be utilized as the stripper stopper, no more detailed description is given or deemed necessary, however, the stripper stopper illustrated is satisfactory in use.

Figure 13:
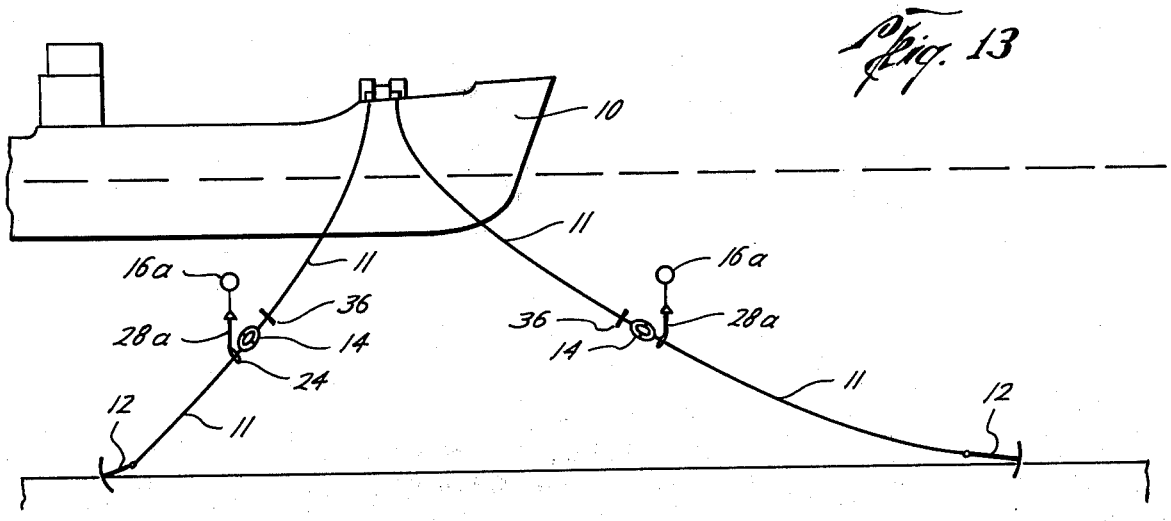
FIG. 13 is a view similar to that of FIG. 1, but illustrates a modified form of marker buoy and grappling means.
Figure 6:
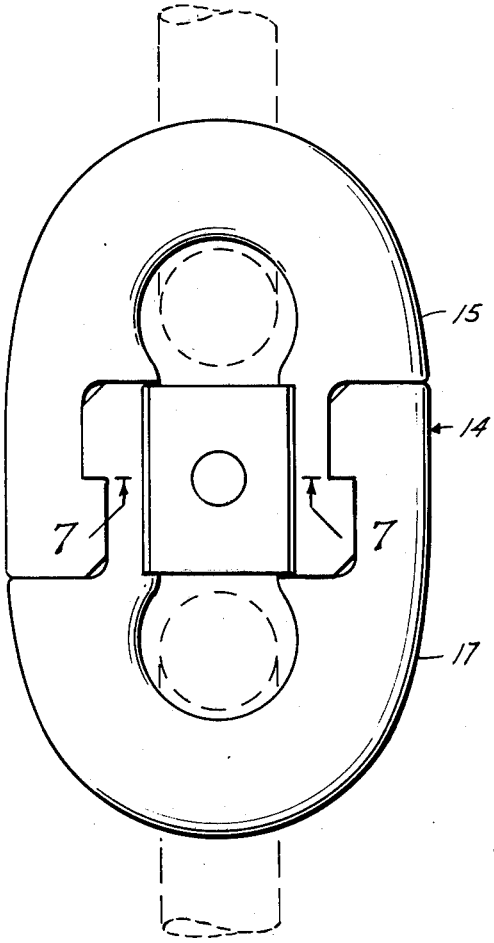
FIG. 6 is an elevational view illustrating an explosive link of the anchor chain which will separate upon detonation, thus releasing the anchor chain.
Figure 14:
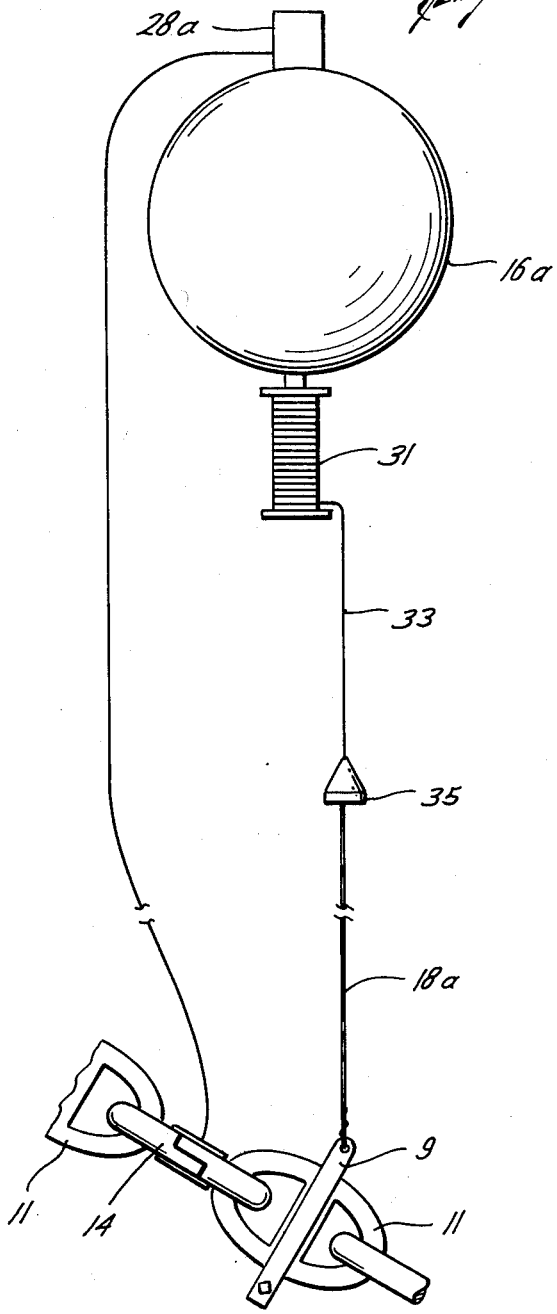
FIG. 14 illustrates a modified form of acoustic buoy and receiver as illustrated in FIG. 13.

Preferably, if desired, for deeper waters to obviate the high cost of surface buoys and pendant lines the marker buoy line can be secured directly to a link of the anchor chain downstream of the explosive link, in which event the strippers 20 and the stripper stoppers 22 and 24 can be omitted. Also, as previously mentioned, any type of explosive separable link can be used and any type of acoustic receiver with a marker buoy which can either be on the surface or submerged, can be used, such as the acoustic receiver 28*a* provided with the submerged marker buoy 16*a* as illustrated in FIG. 13, the details of which are illustrated in FIG. 14, to which Figure reference is now made.

A sonar buoy 16*a* having the acoustic receiver 28*a* and the spool 31 about which is wound the tag line 33, a lightweight line to which is secured the heavier line or pendant 18a and the receiver or male grapple 35. When the acoustic or sonar buoy 16a receives an acoustic signal which detonates the explosive bolt, not shown in this view, of the explosive link 24, the explosive link 24 separates and the reel is freed so that the marker buoy 16a rises to the surface taking the lightweight tag line 33 with it. It is to be noted that the buoy can be also released separately at a latter date such as when repositioning by having it on a coded signal. A male grappling element 37, a chaser, is lowered from the surface of the water down about the tag line 33 and brings with it the heavier pendant retrieving line 39 until it engages and is secured to the female grappler 41. The anchor chain 11 and anchor connected to it, not shown in these views, can then be hoisted to the surface by means of the lines 39 and 28a.

Figure 15:
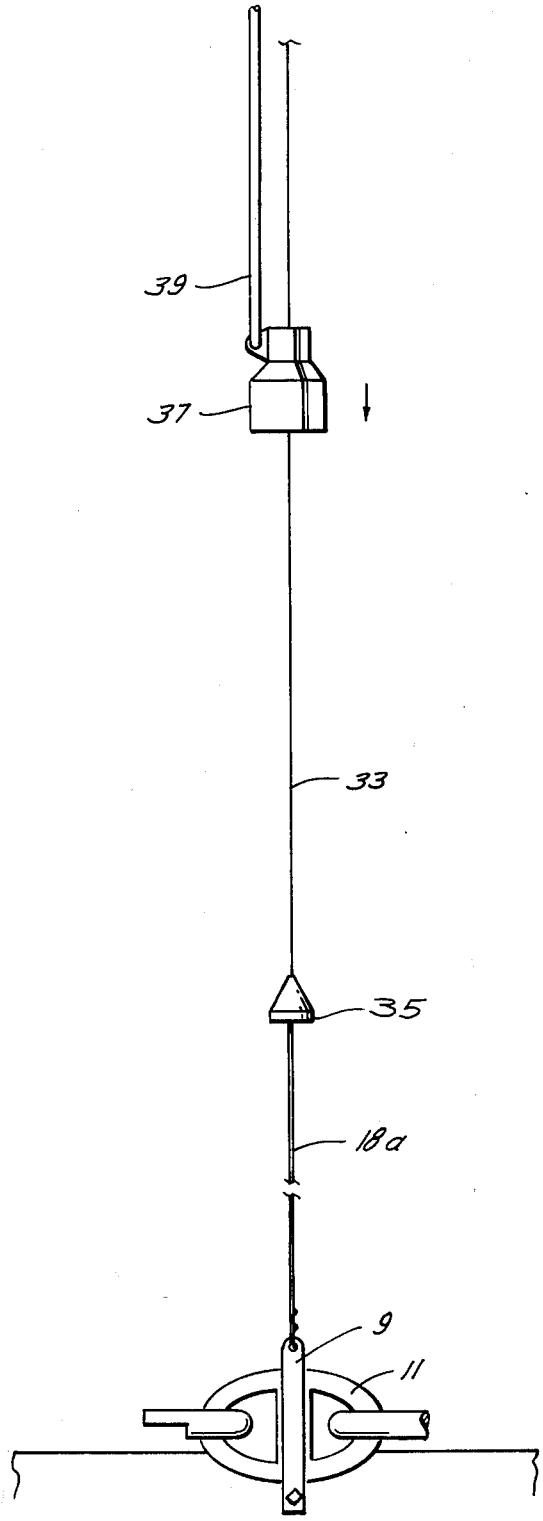
FIG. 15 illustrates the acoustical buoy after the explosive link has been detonated and the buoy has been released to go to the surface, with a grappling member attached to its own separate and independent retrieving line extending down the tag line.
Figure 16:
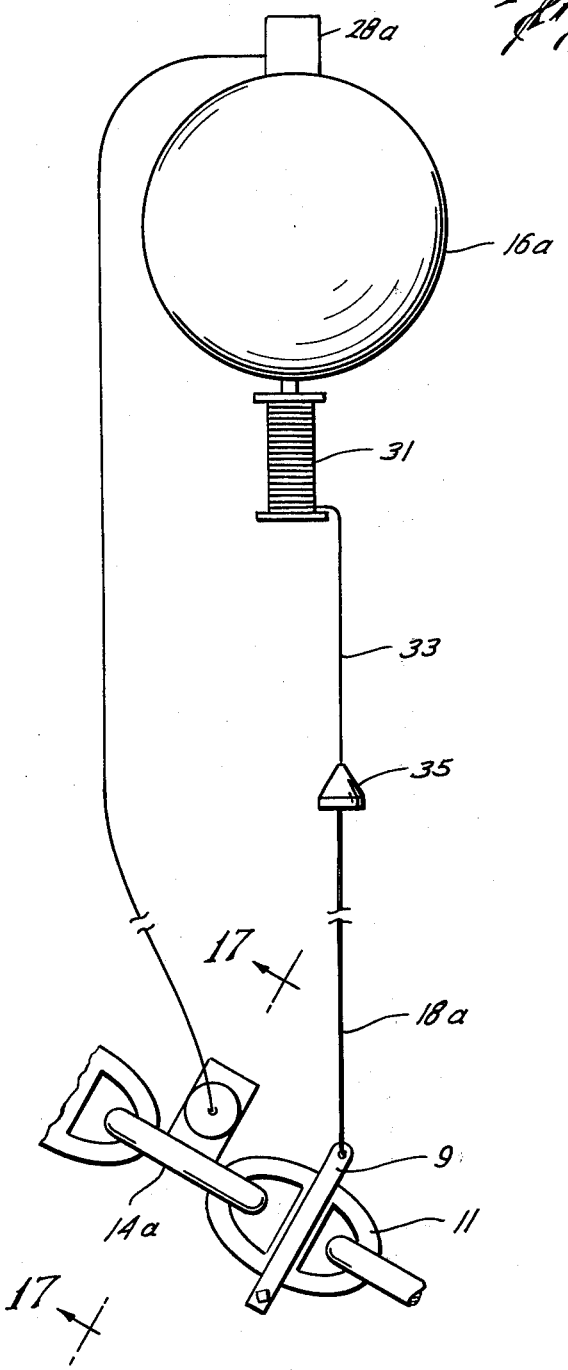
FIG. 16 is a view similar to that of FIG. 14 but illustrates a modified form of explosive link.
Figure 17:
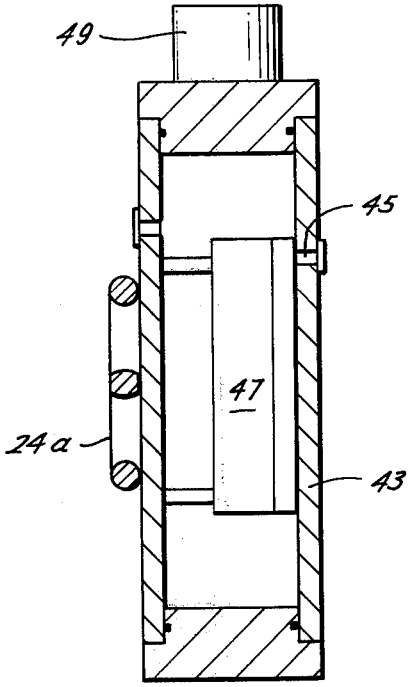
FIG. 17 is a view taken along the line 17—17 of FIG. 16.

A modified form of explosive link is illustrated in FIGS. 16 and 17, which can be used satisfactorily in the system, and to which Figures reference is now made. In this embodiment the separable link 14a is separated by a shaped charge assembly, including a cylindrical container 43 provided with the fill holes 45 for providing a measured amount of explosive to the shaped charge container 47 and includes the signal box 49. The other parts of this arrangement and its operation and method of use are the same as described in connection with FIGS. 14 and 15. In short, however, upon receipt of the proper acoustic signal by the acoustic receiver 28a, the shaped charge 47 is detonated which causes a separation, via disintegration, of the sacrificial or expendable separable link 14a. This also permits the reel 31 to be released so that the marker buoy 16a can rise to the surface, bringing the line 33 with it. However, via a separate coded signal this release can be postponed until desired. When it is desired to hoist the anchor chain 11 and anchor, connected to it, now shown in this view, the chaser grappler 37 is lowered down the line 33 until a connection is made between the engaging parts 37 and 41 and the anchor chain left on the bottom can then be hoisted to the surface as previously described.

No more description is given or deemed necessary of the particular link separating arrangement illustrated in FIGS. 16 and 17 as such a device is available on the commercial market, for example, from Wellex of Houston, Texas.

Figure 2:
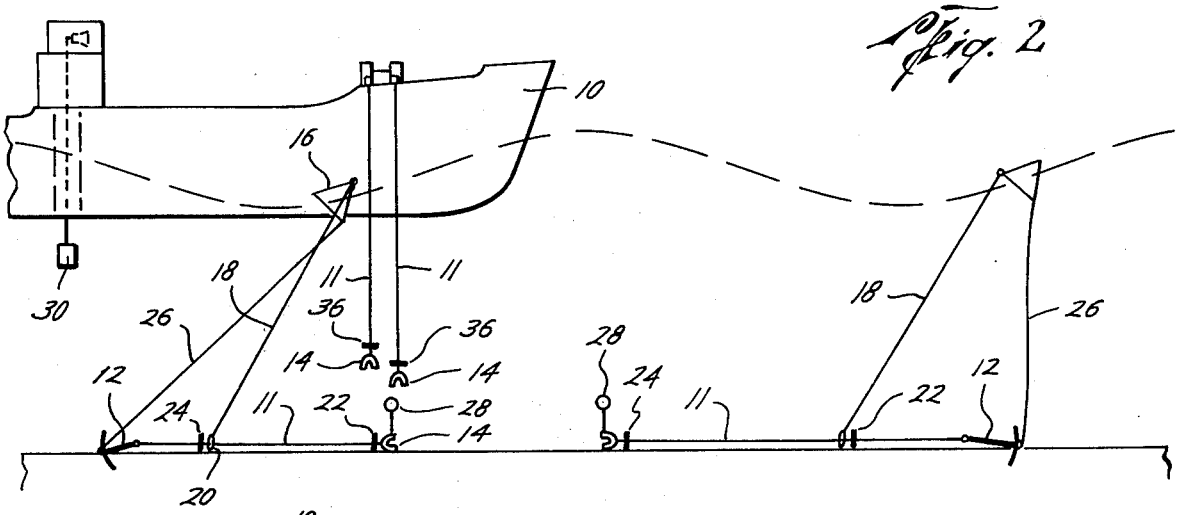
FIG. 2 is a view similar to that of FIG. 1, illustrating high seas and an emergency situation, in which the anchors have been released from the anchor chains, leaving only a small portion of anchor chain with the anchors on bottom, so that the vessel can move off location.

With reference again to FIGS. 1 and 2, in an emergency situation, all explosive links 14 can be blown selectively. Normally, there are two anchor chains and anchors at starboard and port at both the bow and stern making a total of eight anchors and anchor chains. All eight of the explosive links 14 can be blown selectively in about 30 seconds, which completely frees the vessel from all anchors and connection to the sea bottom, such as illustrated in FIG. 2. The free portions of the anchor chains 11 can then be hoisted upwardly, and the stoppers 36 prevent the chains with the separable links 14 from falling into their respective anchor chain lockers. The equipment left on bottom includes the anchors 12 and portions of the anchor chains 11 left up to the explosive links 14. Thus, the vessel then can be moved off of location in a relatively short period of time. It is necessary, of course, to release the riser package from the subsea wellhead which can be done rapidly and safely such as when using a blowout preventer handling system as described and claimed in copending application Ser. No. 729,494, filed Oct. 4, 1976.

Figure 3:
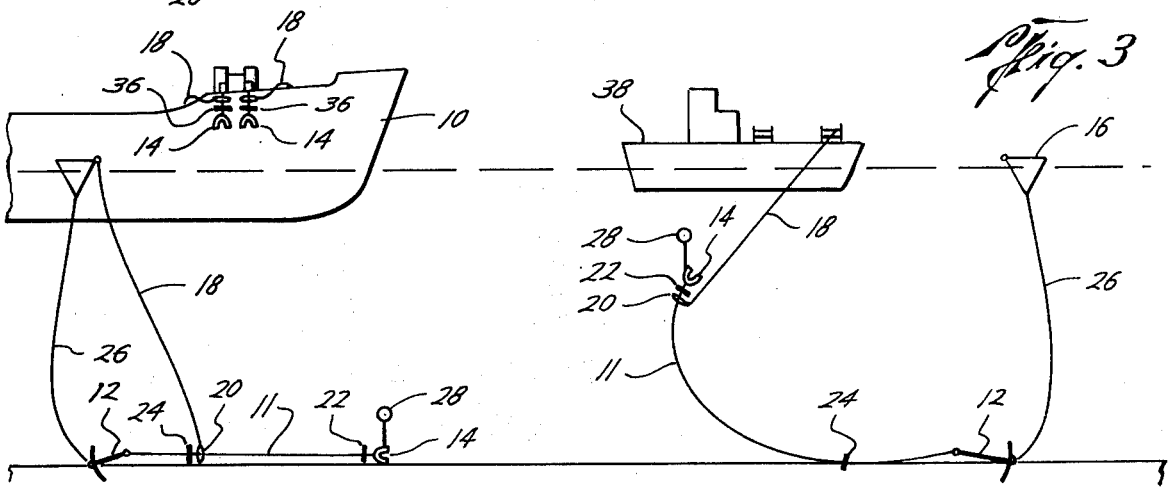
FIG. 3 is a view similar to that of FIGS. 1 and 2 and illustrates a workboat retrieving the anchor chain left on the underwater ground with the anchor.
Figure 4:
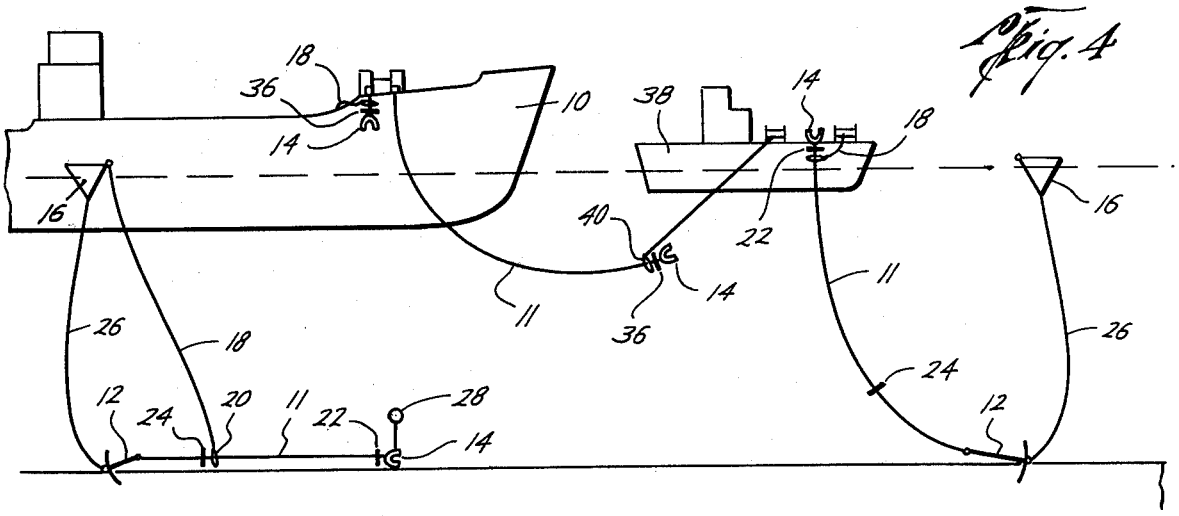
FIG. 4 is a view similar to that of FIG. 3 and illustrates the workboat pulling the anchor chain from the vessel over to the explosive link on the upper end of the anchor chain connected to the anchor so that the link may be reconnected.
Figure 5:
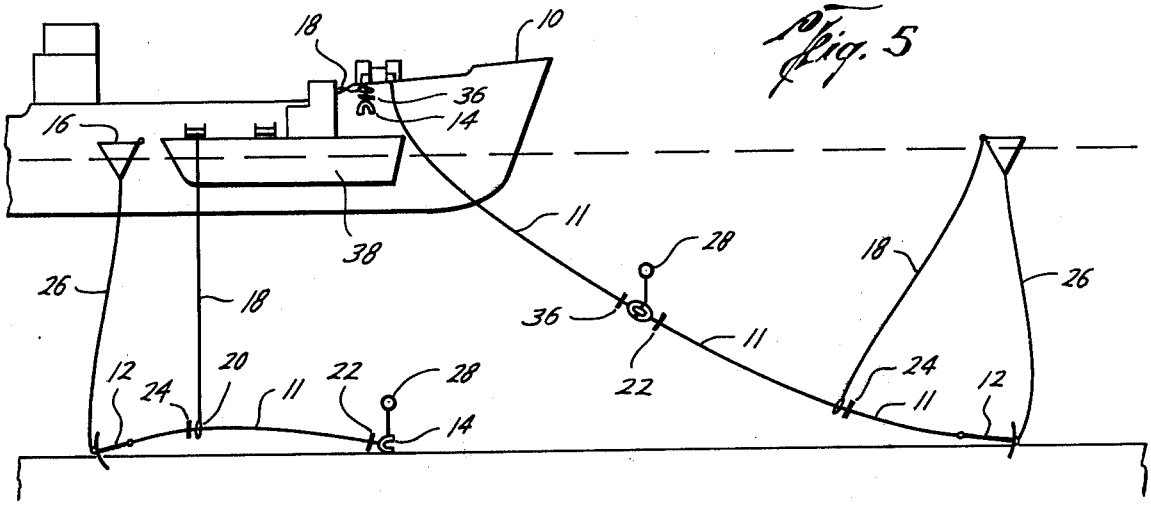
FIG. 5 is a view similar to that of FIGS. 3 and 4 and illustrates the anchor chain as reconnected and the workboat moving to another anchor chain for the same purpose.

When the emergency situation has subsided and it is safe to move the vessel 10 back on location, and with reference to FIG. 3, a workboat 38 hauls in a stripper pendant line 18 which cause the stripper 20 to slide along the anchor chain 11 until it is stopped by the stripper stopper 22 immediately adjacent the explosive or separable link 14 and then hauls the portion of the anchor chain 11 and remaining portion of the explosive link 14 to the surface as best seen in FIG. 4. The workboat 38 has previously attached a line or portable stripper 40 immediately upstream of the stripper stopper 36 and remaining portion of the explosive link on the retrieved portion of the anchor chain 11 and moves it away from the vessel 10 to the location of the anchor buoy 16. The workboat 38 will then have the two portions of the explosive link 14 and will reconnect them simply by replacing the explosive bolt and conical or wedge segments which are the only sections that fail because the explosive link 14 does not disintegrate upon detonation. The reconnected anchor chain 11 is then lowered to bottom and tensioned from the vessel 10, and the stripper pendant or line 18 and stripper are then pulled back toward the anchor 16 and reattached to the anchor buoy 16. This procedure is repeated for each of the separated anchor chains. Because of the ease in retrieving and reconnecting sections of the anchor lines 11, a vessel having eight such anchor lines can be repositioned on location in a matter of hours after an emergency disconnect without the use of divers or grapples.

The same general procedure is used when using the submerged marker buoys and separable link or sacrificial link arrangements of FIGS. 14–17. As previously mentioned, once the separable links 14 and 14a have been detonated, the reels 31 can simultaneously release the cables 33 so that the marker buoys 16a surface or the reels can release the cables at a latter date when returning to location via a separate coded acoustic signal. The vessel may then leave location until subsidence of the emergency situation and then return. The workboat then puts a chaser 37 about a tag line 33 thus lowering a retrieving line 39 until the chaser 37 grapples and is secured to a female grappler 41 at which time the portion of the anchor chain 11 is hoisted to the surface by the lines 39 and 28a and reconnected as described. In this arrangement, however, in addition to reconnecting the explosive link, the tag line 33 is again wound about the reel 31 so that the marker buoy 16 and 16a are again submerged such as illustrated in FIG. 13. In the event a separate reel release system is employed this release system is reactivated prior to lowering the marker buoy.

If any of previous retrieving means fails a specially designed grapple can be utilized to lock into any link of the submerged chain without slipping thereby precluding the necessity of grappling halfway down the submerged length of chain to prevent it from rolling off the grapple because of unbalanced weight. This arrangement also minimizes the lifting requirement of the surface equipment by permitting grappling toward the free end of the chain instead of the mid-section.

The grapple includes a generally tubular body 40 provided with three grapple hooks 42 spaced 120° from each other. These grapple hooks 42 are generally flat, flute-like structures tapered outwardly and upwardly at their outer edges 44 and their inner edges 46. The inner edges of 46 are notched and provided with straight-walled portions 48 where the inner edges 46 converge to provide a locking space of a size which fits any link of the anchor chain 11 snugly so that the anchor chain links do not and cannot slide through the hooks 42.

Plate-like connecting members 50 and 52 are provided at each end of the tubular body 40 which are provided with openings through which the line 52 may be secured for lowering the grapple to the bottom and grappling for the anchor chain.

The present invention, therefore, is well-suited and adapted to obtain the objects and ends and has the advantages and features mentioned as well as others inherent therein.

While presently preferred embodiments of the invention have been given for the purpose of disclosure, changes can be made therein which are within the spirit of the invention as defined by the scope of the appendant claims.

What is claimed is:

1. A releasable and retrievable mooring system for a vessel comprising, at least one anchor, an anchor chain connected to the anchor, an explosive or sacrificial link in the anchor chain arranged to separate the anchor chain upon detonation, an acoustic receiver secured to the explosive link, means operable from the vessel to send an acoustic signal to the acoustic receiver effective to detonate the explosive link and separate the anchor chain, a stripper slidably secured around the anchor chain between the explosive link and the anchor, stoppers secured to the anchor chain on each side of and adjacent to the link, a marker anchor buoy having a first line extending to and secured to the stripper, and a second line extending to and secured adjacent to the anchor, whereby on sending the acoustic signal the anchor chain is severed into a free portion upstream from the link and an anchor portion downstream from the link thereby freeing the vessel from the anchor, the free portion can be hauled in and the stopper arranged to prevent the end of the free portion from falling into its chain locker, the first line can be disconnected from the anchor marker buoy and the end of the anchor portion adjacent the link can be hauled in by the first line for reconnection to the free portion or the anchor retrieved, the marker anchor buoy indicating the position of the anchor by connection thereto by the second line.

2. The releasable and retrievable mooring system of claim 1 where, there are a plurality of anchor chains, and the explosive link for each anchor chain is arranged to detonate at different acoustic signals, and the means to send the acoustic signal includes means to send the different acoustic signals.

3. The mooring system of claim 1, including, an additional stopper on the anchor chain adjacent the anchor and outwardly of the stripper.

4. The mooring system of claim 1, where there are a plurality of anchor chains and the explosive link for each anchor chain is arranged to detonate from different acoustic signals, the means to send the acoustic signal includes means to send the different acoustic signals, and an additional stopper is provided on the anchor chain adjacent to the anchor.

5. A releasable and retrievable mooring system for a vessel comprising, at least one anchor, an anchor chain connected to the anchor, an explosive link in each anchor chain remote from the anchor arranged to separate the anchor chain upon detonation, an acoustic receiver secured to the explosive link, means operable from the vessel to send an acoustic signal to the acoustic receiver effective to detonate the explosive link, a marker anchor buoy arranged to be on the surface at least after detonation of the explosive link, a line extending from the marker anchor buoy to the anchor chain adjacent to and downstream of the explosive link, and a stopper on the chain adjacent to and upstream from the link, whereby on sending the acoustic signal the anchor chain is severed into a free portion upstream from the link and an anchor portion downstream from the link, thereby freeing the vessel from the anchor, the free portion can be hauled in and the stopper arranged to prevent the free portion's end from falling into its chain locker, the end of the anchor portion adjacent the link can be retrieved and hauled in for connection to the free end by the line.

6. The mooring system of claim 5, where the surface marker buoy is arranged to surface when the explosive link is detonated, or at a latter date using a separate acoustic code, and includes, a first engageable and connectable member connected to the line extending from the buoy, and a second engageable and mating connectable member slidable about the line arranged to be lowered and to engage and connect to the first engageable and connectable member for retrieving the anchor.

7. The mooring system of claim 5, where there are a plurality of anchor chains and the explosive link for each anchor chain is arranged to detonate from different acoustic signals, and the means to send the acoustic signal includes the means to send the different acoustic signals.

8. The mooring system of claim 5, where there are a plurality of anchor chains and the explosive link for each anchor chain is arranged to detonate from different acoustic signals, the means to send the acoustic signal includes means to send the different signals, the surface marker buoy is arranged to surface when the explosive link is detonated, or at a latter date using a different acoustic code and includes, a first engageable and connectable member connected to the line extending from the buoy, and, a second engageable and mating connectable member slidable about the line arranged to be lowered and to engage and connect to the first engageable member for retrieving the anchor.

* * * * *

UNITED STATES PATENT AND TRADEMARK OFFICE

CERTIFICATE OF CORRECTION

PATENT NO. : 4,067,282

DATED : January 10, 1978

INVENTOR(S) : David C. Guinn et al.

It is certified that error appears in the above—identified patent and that said Letters Patent is hereby corrected as shown below:

Column 6, line 23, "anchor 16" should read -- anchor buoy 16 --.

Signed and Sealed this

*First* Day of *April 1980*

[SEAL]

*Attest:*

SIDNEY A. DIAMOND

*Attesting Officer*

*Commissioner of Patents and Trademarks*